US009963796B2

(12) United States Patent
Mu et al.

(10) Patent No.: US 9,963,796 B2
(45) Date of Patent: May 8, 2018

(54) METHOD OF PRODUCING TITANIUM METAL WITH TITANIUM-CONTAINING MATERIAL

(71) Applicant: PANGANG GROUP PANZHIHUA IRON & STEEL RESEARCH INSTITUTE CO., LTD., Sichuan Province (CN)

(72) Inventors: Hongbo Mu, Panzhihua (CN); Tianzhu Mu, Panzhihua (CN); Sanchao Zhao, Panzhihua (CN); Fuxing Zhu, Panzhihua (CN); Bin Deng, Panzhihua (CN); Weixing Peng, Panzhihua (CN); Beilei Yan, Panzhihua (CN)

(73) Assignee: PANGANG GROUP PANZHIHUA IRON & STEEL RESEARCH INSTITUTE CO., LTD., Panzhihua, Sichuan Province (CN)

( * ) Notice: Subject to any disclaimer, the term of this patent is extended or adjusted under 35 U.S.C. 154(b) by 110 days.

(21) Appl. No.: 14/062,427

(22) Filed: Oct. 24, 2013

(65) Prior Publication Data

US 2014/0116888 A1 May 1, 2014

(30) Foreign Application Priority Data

Oct. 25, 2012 (CN) ..... 2012 1 0412081

(51) Int. Cl.

| | |
|---|---|
| ***C25C 3/26*** | (2006.01) |
| ***C25C 3/28*** | (2006.01) |
| ***C25C 7/00*** | (2006.01) |
| ***C25C 5/04*** | (2006.01) |
| ***C25C 7/06*** | (2006.01) |

(52) U.S. Cl.
CPC ..... *C25C 3/28* (2013.01); *C25C 5/04* (2013.01); *C25C 7/06* (2013.01)

(58) Field of Classification Search
CPC ..... C25C 3/26; C25C 3/28; C25C 7/00
USPC ..... 205/398
See application file for complete search history.

(56) References Cited

U.S. PATENT DOCUMENTS

| | | | | |
|---|---|---|---|---|
| 9,015 | A | 6/1852 | Daniels | |
| 12,015 | A | 11/1854 | Robertson | |
| 3,081,237 | A * | 3/1963 | Piper | C04B 35/50 204/294 |
| 7,410,562 | B2 | 8/2008 | Withers et al. | |

FOREIGN PATENT DOCUMENTS

| | | |
|---|---|---|
| CN | 1712571 | 12/2005 |
| CN | 101343755 | 1/2009 |
| CN | 101509139 | 8/2009 |
| CN | 101914788 | 12/2010 |
| CN | 102634820 | 8/2012 |
| JP | 2003313694 | 11/2003 |

* cited by examiner

*Primary Examiner* — Zulmariam Mendez
(74) *Attorney, Agent, or Firm* — Brooks Kushman P.C.

(57) ABSTRACT

A method of producing titanium metal with titanium-containing material which includes mixing, pressing and drying the titanium-containing material with a carbonaceous reducing agent to obtain a resultant as a first anode. Using a metal or an alloy as a first cathode, and using an alkali metal chloride molten salt and/or an alkaline earth metal chloride molten salt as a first electrolyte to constitute a first electrolysis system, to perform pre-electrolysis in an inert atmosphere to obtain a residual anode. After the residual anode is washed, molded and dried, using the residual anode as a second anode, using a metal or an alloy as a second cathode, using an alkali metal chloride molten salt and/or an alkaline earth metal chloride molten salt as a second electrolyte to constitute a second electrolysis system, to perform electrolysis in an inert atmosphere to obtain titanium metal powder.

10 Claims, No Drawings

METHOD OF PRODUCING TITANIUM METAL WITH TITANIUM-CONTAINING MATERIAL

CROSS-REFERENCE TO RELATED APPLICATION

This application claims priority to Chinese patent application No. 2012 10 412 081.7 filed on Oct. 25, 2012, the disclosure of which is incorporated in its entirety by reference herein.

BACKGROUND

Field of the Invention

The present disclosure relates to a technical field of preparing a titanium metal by molten salt electrolysis, more particularly, to a method for directly producing a titanium metal powder with titanium-containing material such as high titanium slag and rutile.

Background Art

A titanium metal has many advantages such as low density, good corrosion resistance, plasticity, high specific strength and the like, which is widely used in fields such as aerospace, artificial satellite, military industry, chemical industry, petroleum, metallurgy, light industry, electric power, seawater desalination, naval ships, textile process and medical treatment, thus the titanium metal is acclaimed as the Metal of 21st.

Currently, the industrial production method of sponge titanium is still a magnesiothermic reduction process, which includes: a titanium mineral is enriched, chlorinated and rectified to prepare $TiCl_4$, then after the $TiCl_4$ is reduced to the sponge titanium using magnesium in argon or helium inert atmosphere, the magnesium and $MgCl_2$ are separated and removed by performing vacuum distillation, finally the sponge titanium is finishing processed to obtain a finished sponge titanium. The method has a high productivity and facilitates commercialization, thus it seems that this method is irreplaceable so far. However, the method has disadvantages such as long process flow, long production period, low reduction ratio, high price of a reducing agent, and difficulty in achievement of continuous processes, resulting in high manufacturing cost of the sponge titanium.

There are many methods for preparing a titanium metal, and representative methods are as follows: an FFC method proposed by Cambridge University, an OS method proposed by Kyoto University, a PRP method proposed by Okabe etc. from Japan, and fluotitanate reduction etc. However, the industrialization has not been realized so far, because each method has technical problems that cannot be resolved currently.

A Chinese patent application with a publication number CN1712571 A discloses a method of preparing pure Ti through electrolysis directly from solid solution anode TiO.mTiC with metal conductivity. The solid solution anode TiO.mTiC in this method uses carbon and titanium dioxide or titanium carbide and titanium dioxide as raw material, the raw material is mixed in powder form based on reaction stoichiometry, then the raw material is pressed and molded and the raw material reacts in vacuum at 600-1600° C. to obtain the solid solution anode TiO.mTiC. The above method has the advantages such as simple process, and continuous electrolysis processes; however, the method needs to prepare solid solution TiO.mTiC under the conditions of vacuum and high temperature, thus the method has a high energy consumption and uses high-cost titanium dioxide as materials.

An United States patent document with a publication number U.S. Pat. No. 7,410,562B2 discloses a method of preparing a titanium metal using a composite anode of $TiO_2$—C, which is a combination method of a thermal and an electrochemical process, and the key point of which is heating carbon and titanium-containing material to form a $TiC_xO_y$ composite anode, then using the $TiC_xO_y$ composite anode as a soluble anode to perform molten salt electrolysis, and obtaining the titanium metal at a cathode. The method has the similar advantages and disadvantages to those in the above Chinese patent application, that is, the method also needs to prepare composite anode by thermal reduction under the conditions of vacuum and high temperature, thus the method also has high energy consumption, and which also uses high-cost titanium dioxide as materials.

SUMMARY

With respect to the defect of high energy consumption of the prior art, one of the goals of the present invention is providing a method of producing titanium metal with titanium-containing material with low energy consumption through molten salt electrolysis process.

An aspect of the present invention is to provide a method of producing titanium metal with titanium-containing material, the method includes: mixing, pressing and drying the titanium-containing material with a carbonaceous reducing agent to obtain a resultant as a first anode, using a metal or an alloy as a first cathode, using an alkali metal chloride molten salt and/or an alkaline earth metal chloride molten salt as a first electrolyte to constitute a first electrolysis system, performing pre-electrolysis in inert atmosphere to obtain a residual anode; after the residual anode is washed, molded and dried, using the residual anode as a second anode, using a metal or an alloy as a second cathode, using an alkali metal chloride molten salt and/or an alkaline earth metal chloride molten salt as a second electrolyte to constitute a second electrolysis system, performing electrolysis in inert atmosphere to obtain titanium metal powder.

In one exemplary embodiment of the present invention, the second anode may be obtained by mixing, molding and drying washed residual anode with a carbonaceous reducing agent, the number ratio of oxygen atoms and carbon atoms in elementary substance form in the second anode is controlled within 2:1-1:1.

In one exemplary embodiment of the present invention, the carbonaceous reducing agent is at least one of coal powder, coke powder, activated carbon, graphite, carbon black and petroleum coke.

In one exemplary embodiment of the present invention, the titanium-containing material may be high titanium slag or rutile.

In one exemplary embodiment of the present invention, the titanium-containing material and the carbonaceous reducing agent may have particle sizes that can go through 200-mesh screen.

In one exemplary of the present invention, in the first anode, the number ratio of oxygen atoms in the titanium-containing material and carbon atoms in the carbonaceous reducing agent is 2:1-1:1.

In one exemplary of the present invention, the first cathode and the second cathode may be carbon steel rod, molybdenum rod or titanium rods.

In one exemplary of the present invention, the electrolysis of the second electrolysis system may include controlling current density of the second anode within 0.025 A/cm2-0.75 A/cm2 and controlling current density of the second cathode within 0.1 A/cm2-2 A/cm2.

In one exemplary embodiment of the present invention, the second electrolyte may further contain low-valent titanium ions.

Compared with the prior art, the method of the present invention can perform molten salt electrolysis by using the mixture of the titanium-containing material and the carbonaceous reducing agent as an anode, thereby obtaining the qualified titanium metal powder with the advantages of low energy consumption, low production cost and less titanium loss.

DETAILED DESCRIPTION OF EXEMPLARY EMBODIMENTS

Hereinafter, a method of producing a titanium metal with titanium-containing material according to the present disclosure will be described in detail in combination with exemplary embodiments. In the present disclosure, if no special instructions, the content of material is weight percentage.

In one exemplary embodiment of the present disclosure, a method of producing a titanium metal with titanium-containing material includes:

mixing, pressing and drying the titanium-containing material with a carbonaceous reducing agent to obtain a resultant as a first anode, using a metal or an alloy as a first cathode, using an alkali metal chloride molten salt and/or an alkaline earth metal chloride molten salt as a first electrolyte to constitute a first electrolysis system, then performing pre-electrolysis in inert atmosphere to remove impurity elements such as Fe and Mn etc. and obtain a residual anode;

after the residual anode is washed, molded and dried, using the residual anode as a second anode, using a metal or an alloy as a second cathode, using an alkali metal chloride molten salt and/or an alkaline earth metal chloride molten salt as a second electrolyte to constitute a second electrolysis system, then performing electrolysis in inert atmosphere to obtain titanium metal powder.

In another exemplary embodiment of the present disclosure, the titanium-containing material may be high titanium slag or rutile. However, the present disclosure is not limited thereto, other mixtures which contain TiO2 as main composition and contain a predetermined amount (e.g. 5%-15%) of impurities may be used as the titanium-containing material of the present disclosure. In addition, the carbonaceous reducing agent may be at least one of coal powder, coke powder, activated carbon, graphite, carbon black and petroleum coke. However, the present disclosure is not limited thereto, other materials which contain carbon elementary substance as main composition also can be used as the carbonaceous reducing agent of the present disclosure. In addition, preferably, the titanium-containing material and the carbonaceous reducing agent may have particle sizes that can go through 200-mesh screen, which can improve metallurgical kinetic conditions of the method of the present disclosure, and improve the efficiency of solid-solid phase reaction. However, the present disclosure is not limited thereto, that is to say, titanium-containing material and carbonaceous reducing agent with particle size greater than the above particle size also can be used as material of the present disclosure.

In another exemplary embodiment of the present disclosure, preferably, when forming the first anode, the number ratio of oxygen atoms in the titanium-containing material and carbon atoms in the carbonaceous reducing agent is 2:1-1:1. In such a range, the titanium-containing material and the carbonaceous reducing agent which form the first anode can react completely during the electrolysis after the pre-electrolysis. In addition, it also can mix, mold and dry washed residual anode with the carbonaceous reducing agent to form the second anode and control the number ratio of the oxygen atoms and the carbon atoms in elementary substance form in the second anode within 2:1-1:1, such that the oxygen atoms in the titanium-containing material can completely react with the carbon atoms in the carbonaceous reducing agent. However, the present disclosure is not limited thereto, that is to say, anode formed of material which goes beyond the above range is also suitable for the method of the present disclosure.

In another exemplary embodiment of the present disclosure, preferably, the first cathode or the second cathode is carbon steel rod, molybdenum rod or titanium rod. In the method of the present disclosure, as electrolysis reaction in the second electrolysis system occurs, generated titanium powder will attach to the second cathode (for example, sometimes, it corresponds to coat a layer of titanium powder on surface of the second cathode), therefore, the method of the present disclosure can further adopt other materials which are different from above cathode materials.

In another exemplary embodiment of the present disclosure, preferably, the method may further includes controlling current density of anodes within 0.025 A/cm2-0.75 A/cm2 and controlling current density of cathodes within 0.1 A/cm2-2 A/cm2, thereby achieving good electrolysis efficiency. However, the present disclosure is not limited thereto, those skilled in the art may determine the current densities of the anodes and the cathodes according to the specific conditions of the electrolytic reaction.

In another exemplary embodiment of the present disclosure, preferably, the second electrolyte further contains low-valent titanium ions. For example, the low-valent titanium ions can be added by means of TiCl2 and TiCl3. More preferably, the total quality of the TiCl2 and TiCl3 may account for 0.4%-3% by weight in the second electrolyte, and wherein atom number ratio of bivalent titanium atoms and trivalent titanium atoms may be 1:5-1:0.5, thereby achieving good electrolysis efficiency. However, the present disclosure is not limited thereto, in the method of the present disclosure, if only a little Ti3+ and Ti2+ exist in a second molten salt electrolyte, electrolytic reaction may be promoted to improve electrolysis efficiency, therefore, even if the content of the TiCl2 and TiCl3 in the second electrolyte and the atom number ratio thereof do not fall in the above corresponding ranges respectively, the method of the present disclosure also can be performed.

In addition, the molten salt of the present disclosure may be one or more of the alkaline metal chlorides or the alkaline-earth metal chlorides, such as, LiCl, CaCl2, KCl and NaCl etc.

Hereinafter, the present disclosure will be briefly described in connection with a preferable embodiment.

First, high titanium slag or rutile is mixed with a carbonaceous reducing agent, in which a weight ratio of TiO2 contained in the high titanium slag or rutile relative to C contained in the carbonaceous reducing agent is 100:30, then the high titanium slag or rutile is uniformly mixed with the carbonaceous reducing agent in a ball mill. The above mixed uniformly powder is pressed to a predetermined shape.

The above mixture having the predetermined shape is used as an anode, a carbon steel is used as a cathode, which are pre-electrolyzed in a first molten salt electrolyte to remove impurities. Since the high titanium slag or rutile contains a predetermined amount of SiO2, CaO, MgO and Al2O3 which will do not affect the quality of a titanium metal; however, the high titanium slag or rutile further contains a little MnO and FeO etc., because of electrode potential, in order to ensure the quality of titanium metal powder, these elements need to be removed.

A second electrolyte which contains low-valent titanium ions with a predetermined concentration is prepared.

A residual anode is formed after impurities are removed from the anode, and is then washed, and after carbon content of the residual anode is adjusted (e.g. in a second anode, the number ratio of oxygen atoms and carbon atoms in elementary substance is controlled within 2:1-1:1), the residual anode is molded and dried, and electrolyzed in the second electrolyte, thereby obtaining the qualified titanium metal powder.

In conclusion, the method of the present disclosure which includes mixing, pressing and drying the titanium-containing material and the carbonaceous reducing agent to obtain a resultant as an anode, and pre-electrolyzing and electrolyzing the anode in a molten salt system to obtain titanium metal powder has the advantages of low energy consumption and low production cost.

Hereinafter, the method of producing titanium metal with the titanium-containing material of the present disclosure will be further described in conjunction with examples 1-3 which contains specific parameters.

Example 1

100 g of high titanium slag (wherein the content of TiO2 was 90%, the total content of SiO2, CaO, MgO and Al2O3 was 8%, the total content of the oxides of Fe and Mn etc. was about 2%) and 30 g of coke powder which contains about 92% of fixed carbon were uniformly mixed in a planetary ball mill to obtain a mixture, the mixture was pressed and molded under a pressure of 500 kg/cm2 to obtain an anode, a carbon steel rod was used as a cathode, NaCl—KCl—TiCl2-TiCl3 molten salt was used as an electrolyte. Pre-electrolysis was performed at the temperature of 700° C. when an electrolytic bath was protected by argon. The pre-electrolysis was performed under the condition that the current density of the anode was 0.025 A/cm2 and the current density of the cathode was 0.1 A/cm2.

After being introduced a predetermined amount of power, the pre-electrolysis was stopped, the anode was taken out and washed by 0.5% of diluted hydrochloric acid to remove residual electrolyte, then the anode was cleaned by deionized water to remove chlorine ion and dried. The composition of pre-electrolyzed residual anode was analyzed, the composition of the residual anode was adjusted, so that a weight ratio of TiO2 relative to C was 100:30, resultant was mixed uniformly in a planetary ball mill, pressed and molded under the pressure of 500 kg/cm2, molded resultant was used as an anode, and a carbon steel rod was used as a cathode, NaCl—KCl—TiCl2-TiCl3 molten salt was used as an electrolyte. Electrolysis was performed at the temperature of 700° C. when an electrolytic bath was protected by argon. The electrolysis was performed under the condition that the current density of the anode was 0.025 A/cm2, and the current density of the cathode was 0.1 A/cm2. The qualified titanium metal powder was obtained on the cathode, wherein, the titanium metal power contains: Ti of 99.50%, C of 0.05%, O of 0.21%, Fe of 0.05%, Si of 0.02%, Mn of 0.01%, Cl of 0.03% by weight. Titanium loss ratio is about 3%-5%.

Example 2

100 g of rutile (wherein the content of TiO2 was 92%, the total content of SiO2, CaO, MgO and Al2O3 was 6%, the total content of the oxides of Fe and Mn etc. was about 2%) and 30 g of coal powder which contains about 81% of fixed carbon were uniformly mixed in a planetary ball mill to obtain a mixture, the mixture was pressed and molded under the pressure of 500 kg/cm2 to obtain an anode, a carbon steel rod was used as a cathode, NaCl—KCl—TiCl2-TiCl3 molten salt was used as an electrolyte. Pre-electrolysis was performed at the temperature of 800° C. when an electrolytic bath was protected by argon. The pre-electrolysis was performed under the condition that the current density of the anode was 0.025 A/cm2, and the current density of the cathode was 1.0 A/cm2.

After being introduced a predetermined amount of power, the pre-electrolysis was stopped, the anode was taken out and washed by 0.5% of diluted hydrochloric acid to remove residual electrolyte, then the anode was cleaned by deionized water to remove chlorine ion and dried. The composition of pre-electrolyzed residual anode was analyzed, the composition of the residual anode was adjusted, so that a weight ratio of TiO2 relative to C was 100:30, resultant was mixed uniformly in a planetary ball mill, pressed and molded under the pressure of 500 kg/cm2, molded resultant was used as an anode, a molybdenum rod is used as a cathode, NaCl—KCl—TiCl2-TiCl3 molten salt was used as an electrolyte. Electrolysis was performed at the temperature of 800° C. when an electrolytic bath was protected by argon. The electrolysis was performed under the condition that the current density of the anode was 0.050 A/cm2, and the current density of the cathode was 1.0 A/cm2. The qualified titanium metal powder was obtained on the cathode, wherein, the titanium metal power contains: Ti of 99.51%, C of 0.05%, o of 0.22%, Fe of 0.04%, Si of 0.02%, Mn of 0.01%, Cl of 0.03% by weight. Titanium loss ratio is about 3%-5%.

Example 3

100 g of high titanium slag (wherein the content of TiO2 was 90%, the total content of SiO2, CaO, MgO and Al2O3 was 8%, the total content of the oxides of Fe and Mn etc. was about 2%) and 30 g of activated carbon which contains about 80% of fixed carbon were uniformly mixed in a planetary ball mill to obtain a mixture, the mixture was pressed and molded under a pressure of 500 kg/cm2 to obtain an anode, a carbon steel rod was used as a cathode, NaCl—KCl—TiCl2-TiCl3 molten salt was used as an electrolyte. Pre-electrolysis was performed at the temperature of 750° C. when an electrolytic bath was protected by argon. The pre-electrolysis was performed under the condition that the current density of the anode was 0.025 A/cm2 and the current density of the cathode was 0.1 A/cm2.

After being introduced a predetermined amount of power, pre-electrolysis was stopped, the anode was taken out and washed by 0.5% of diluted hydrochloric acid to remove residual electrolyte, then the anode was cleaned by deionized water to remove chlorine ion and dried. The composition of pre-electrolyzed residual anode was analyzed, the composition of the residual anode was adjusted, so that a weight ratio of TiO2 relative to C was 100:30, resultant was mixed uniformly in a planetary ball mill, pressed and molded under the pressure of 500 kg/cm2, molded resultant was used as an anode, and a titanium rod was used as a cathode, NaCl—KCl—TiCl2-TiCl3 molten salt was used as an electrolyte. Electrolysis was performed at the temperature of 750° C. when an electrolytic bath was protected by argon. The electrolysis was performed under the condition that the current density of the anode was 0.075 A/cm2, and the current density of the cathode was 2.0 A/cm2. The qualified titanium metal powder was obtained on the cathode, wherein, the titanium metal power contains: Ti of 99.52%, C of 0.05%, O of 0.20%, Fe of 0.04%, Si of 0.02%, Mn of 0.01%, Cl of 0.03% by weight. Titanium loss ratio is about 3%-5%.

While the present disclosure has been shown and described with reference to exemplary embodiments thereof, however, those skilled in the art should clear that various amendments may be made therein without departing from the spirit and scope of the following claims.

What is claimed is:

1. A method of producing titanium metal from titanium-containing material, characterized in comprising:

mixing the titanium-containing material with a carbonaceous reducing agent;

pressing the mixture to directly form a first anode without performing a reaction under a vacuum or high temperature, and drying the first anode;

using a metal or an alloy as a first cathode;

using an alkali metal chloride molten salt and/or an alkaline earth metal chloride molten salt as a first electrolyte to constitute a first electrolysis system, performing pre-electrolysis in inert atmosphere to remove impurity elements and obtain a residual anode;

washing and drying the residual anode, crushing the residual anode, mixing the crushed residual anode with a carbonaceous reducing agent to adjust a number ratio of oxygen atoms and carbon atoms in an elementary mixture forming a second anode and control the number ratio within 2:1-1:1, and molding the crushed residual anode to directly form the second anode without performing a reaction under a vacuum or high temperature;

using a metal or an alloy as a second cathode, using an alkali metal chloride molten salt and/or an alkaline earth metal chloride molten salt as a second electrolyte to constitute a second electrolysis system; and performing electrolysis using the second anode in inert atmosphere to obtain titanium metal powder.

2. The method of claim 1, wherein the carbonaceous reducing agent is at least one of coal powder, coke powder, activated carbon, graphite, carbon black and petroleum coke.

3. The method of claim 1, wherein the titanium-containing material is high titanium slag or rutile.

4. The method of claim 1, wherein the titanium-containing material and the carbonaceous reducing agent have particle sizes that can go through 200-mesh screen.

5. The method of claim 1, wherein in the first anode, a number ratio of oxygen atoms in the titanium-containing material and carbon atoms in the carbonaceous reducing agent is 2:1-1:1.

6. The method of claim 1, wherein the first cathode and the second cathode are carbon steel rod, molybdenum rod or titanium rods.

7. The method of claim 1, wherein the electrolysis of the second electrolysis system comprises controlling current density of the second anode within 0.025 A/cm2-0.75 A/cm2 and controlling current density of the second cathode within 0.1 A/cm2-2 A/cm2.

8. The method of claim 1, wherein the second electrolyte further contains low-valent titanium ions.

9. The method of claim 1, wherein the carbonaceous reducing agent is at least one of coal powder, coke powder, activated carbon, graphite, carbon black and petroleum coke.

10. The method of claim 1, wherein the titanium-containing material and the carbonaceous reducing agent have particle sizes that can go through 200-mesh screen.

* * * * *